US010347989B2

(12) United States Patent
Takei

(10) Patent No.: US 10,347,989 B2
(45) Date of Patent: Jul. 9, 2019

(54) ROTATIONALLY POLARIZED ANTENNA, TRANSMISSION/RECEPTION MODULE, ELEVATOR CONTROL SYSTEM, AND SUBSTATION CONTROL SYSTEM

(71) Applicant: Hitachi, Ltd., Chiyoda-ku, Tokyo (JP)

(72) Inventor: Ken Takei, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 353 days.

(21) Appl. No.: 15/030,119

(22) PCT Filed: Dec. 17, 2014

(86) PCT No.: PCT/JP2014/083430
§ 371 (c)(1),
(2) Date: Apr. 18, 2016

(87) PCT Pub. No.: WO2016/098201
PCT Pub. Date: Jun. 23, 2016

(65) Prior Publication Data
US 2016/0336655 A1 Nov. 17, 2016

(51) Int. Cl.

| | |
|---|---|
| ***H01Q 1/38*** | (2006.01) |
| ***H01Q 9/04*** | (2006.01) |
| ***H01Q 9/28*** | (2006.01) |
| ***H01Q 5/35*** | (2015.01) |

(52) U.S. Cl.
CPC ..... *H01Q 9/0428* (2013.01); *H01Q 5/35* (2015.01); *H01Q 9/0414* (2013.01); *H01Q 9/285* (2013.01)

(58) Field of Classification Search
CPC ..... H01Q 5/35; H01Q 9/0414; H01Q 9/285; H01Q 9/0428
See application file for complete search history.

(56) References Cited

U.S. PATENT DOCUMENTS

| | | | | |
|---|---|---|---|---|
| 2003/0052825 | A1* | 3/2003 | Rao | H01Q 9/0407 343/700 MS |
| 2006/0197706 | A1* | 9/2006 | Takei | H01Q 1/38 343/700 MS |
| 2011/0012788 | A1* | 1/2011 | Rowell | H01Q 9/0414 343/700 MS |

FOREIGN PATENT DOCUMENTS

| | | |
|---|---|---|
| JP | 7-249933 A | 9/1995 |

* cited by examiner

*Primary Examiner* — Dieu Hien T Duong
(74) *Attorney, Agent, or Firm* — Crowell & Moring LLP

(57) ABSTRACT

In a thin rotationally polarized antenna which performs highly reliable and highly secure wireless communication, in the case where a feeding point is provided in an integrated plate conductor including a plurality of minute conductor segments and is excited at a first frequency and a second frequency different from the first frequency, matching with a feeding circuit is achieved in both a frequency band including the first frequency and a frequency band including the second frequency. Current distribution formed in orthogonal directions on the plate at the first frequency has the same amplitude and has a phase difference of 90 degrees. Current distribution formed in the same orthogonal directions on the plate at the second frequency has the same amplitude and has a phase difference of 90 degrees, and a phase of the current distribution at the first frequency and a phase of the current distribution at the second frequency have opposite directions.

14 Claims, 16 Drawing Sheets

[FIG. 1]
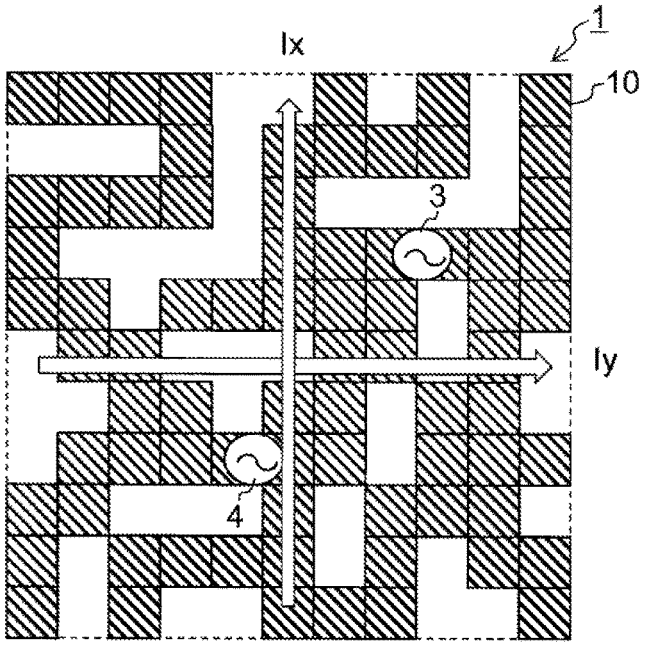
[FIG. 2]
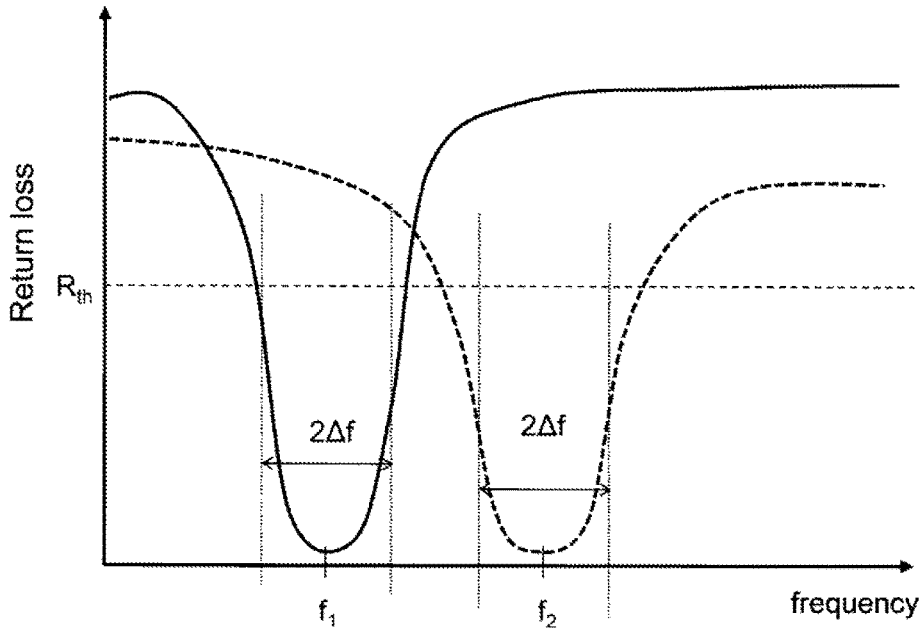

[FIG. 4]
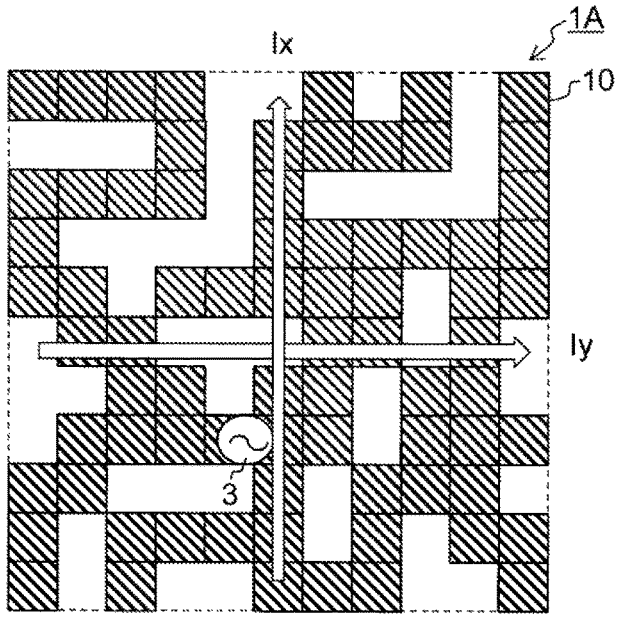
[FIG. 5]
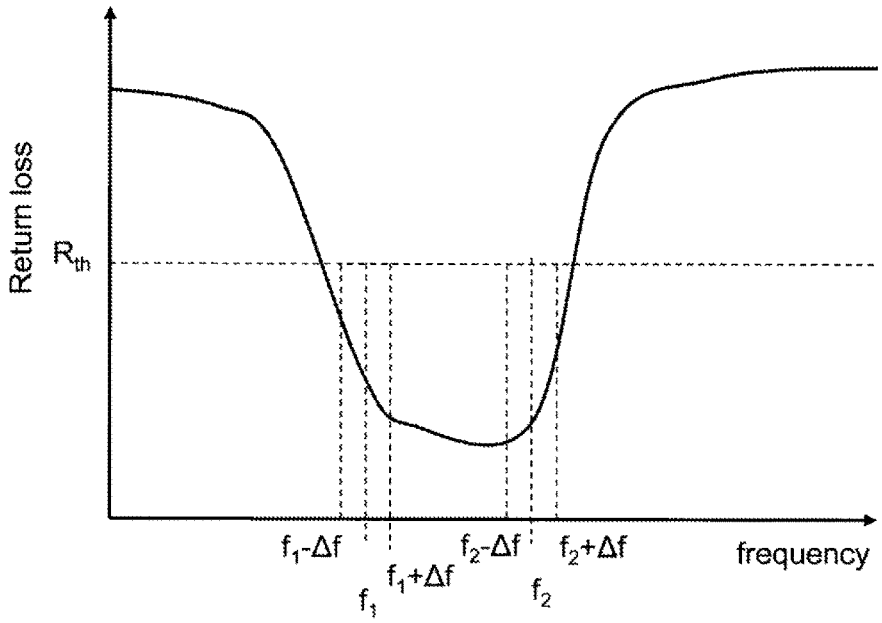

[FIG. 6]
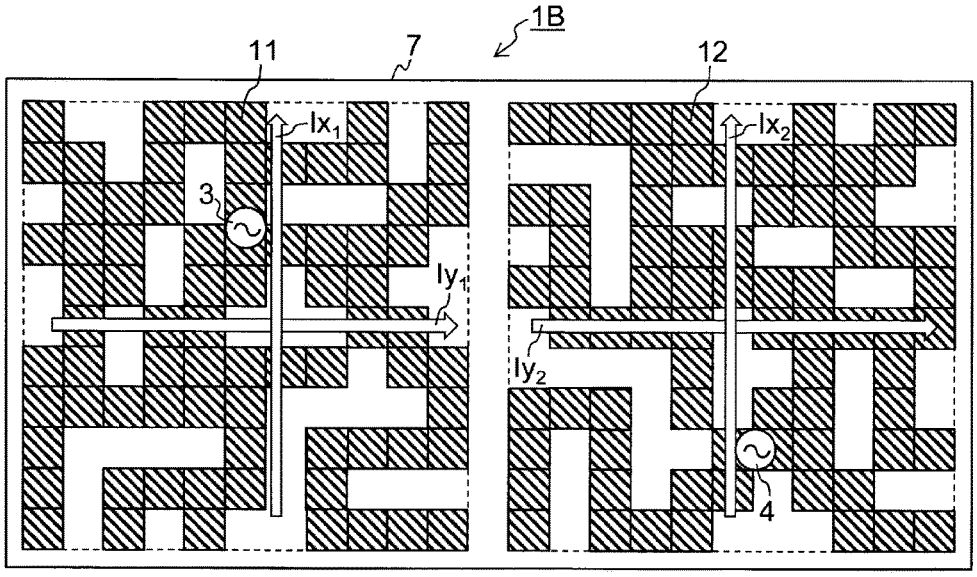
[FIG. 7]
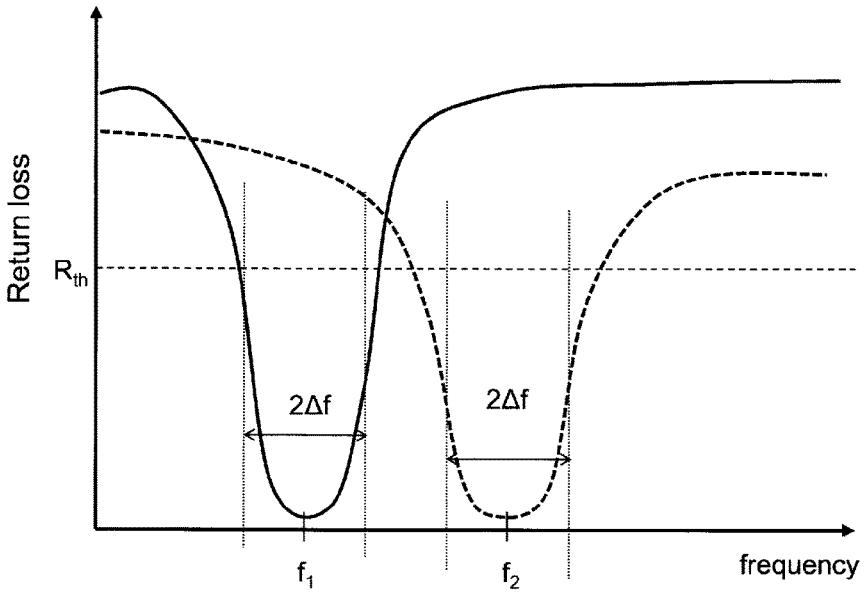

[FIG. 8]
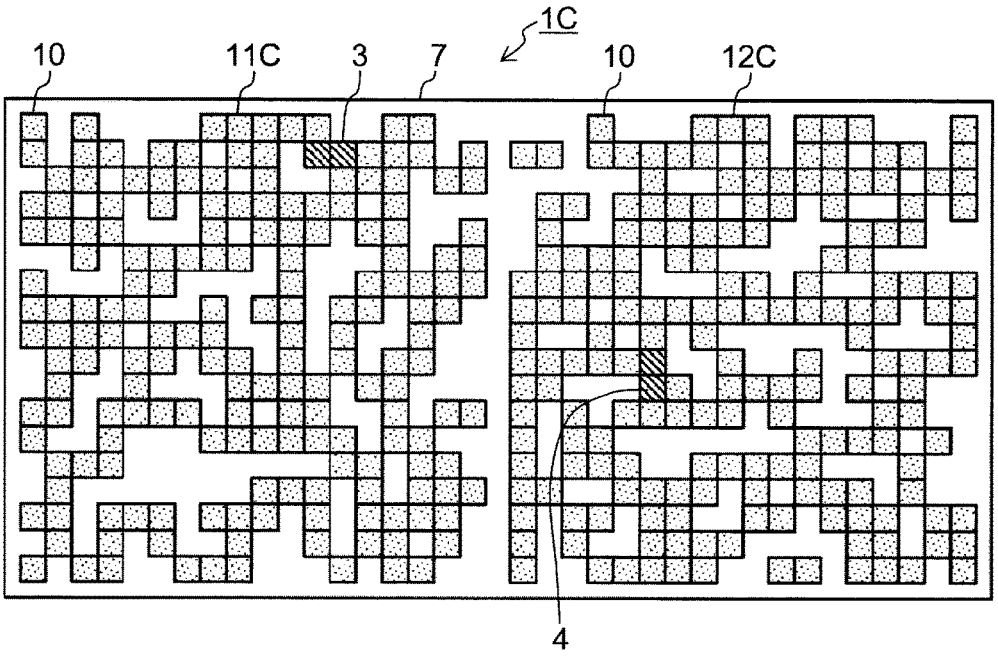

[FIG. 9]
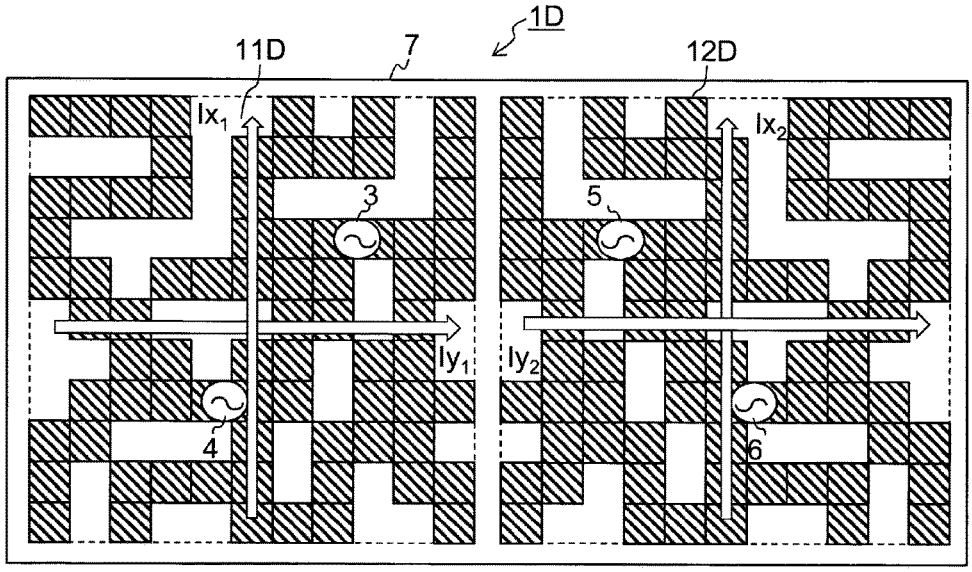
[FIG. 10]
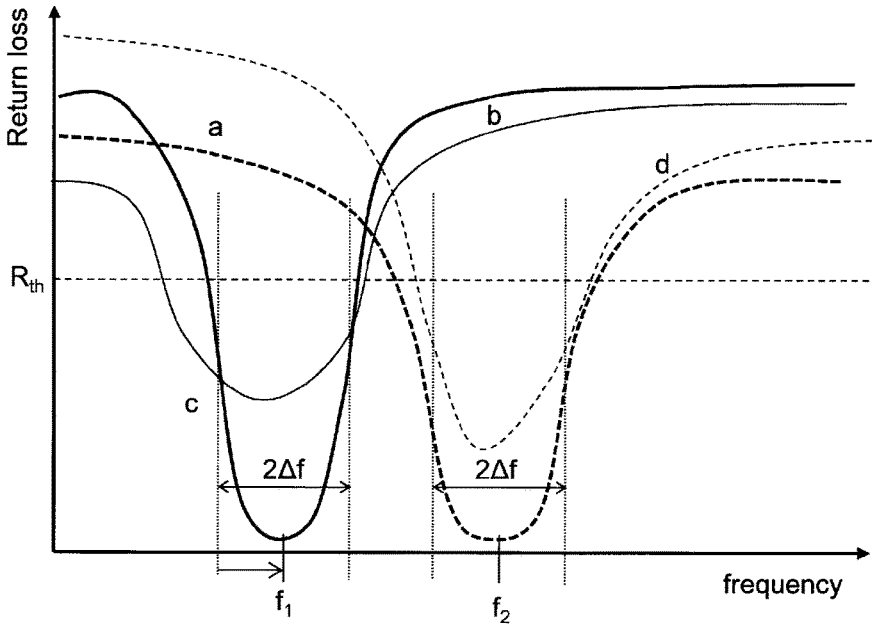

[FIG. 11]
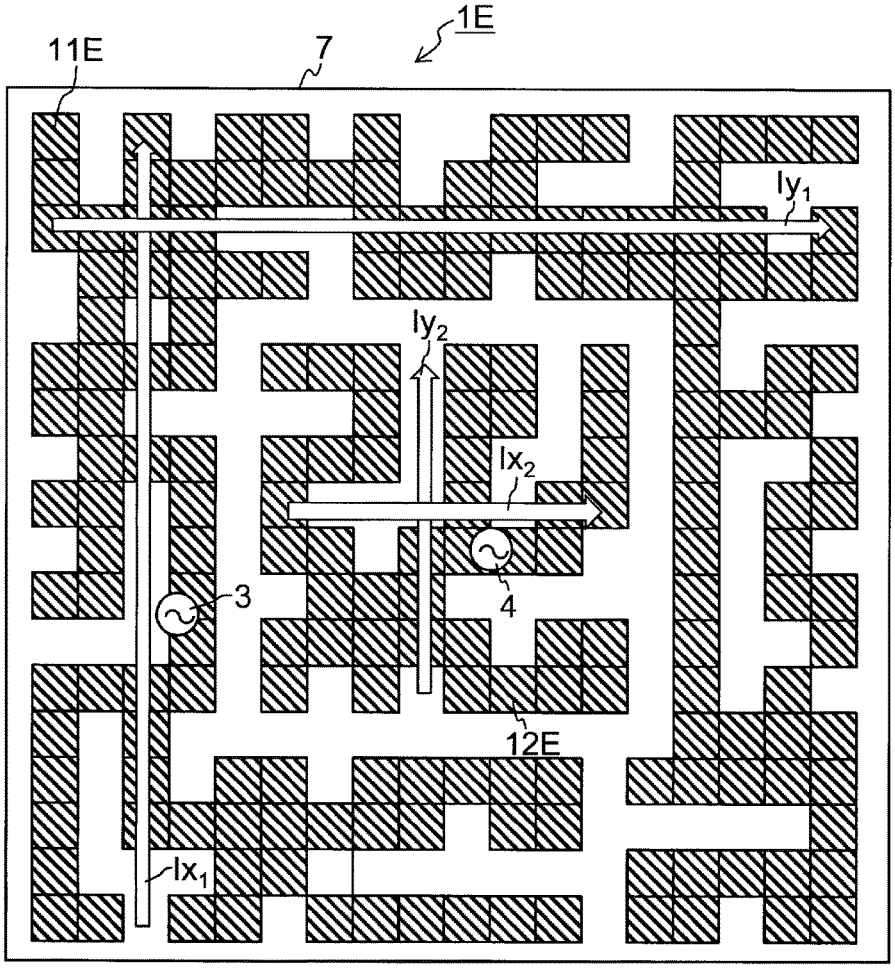

[FIG. 12]
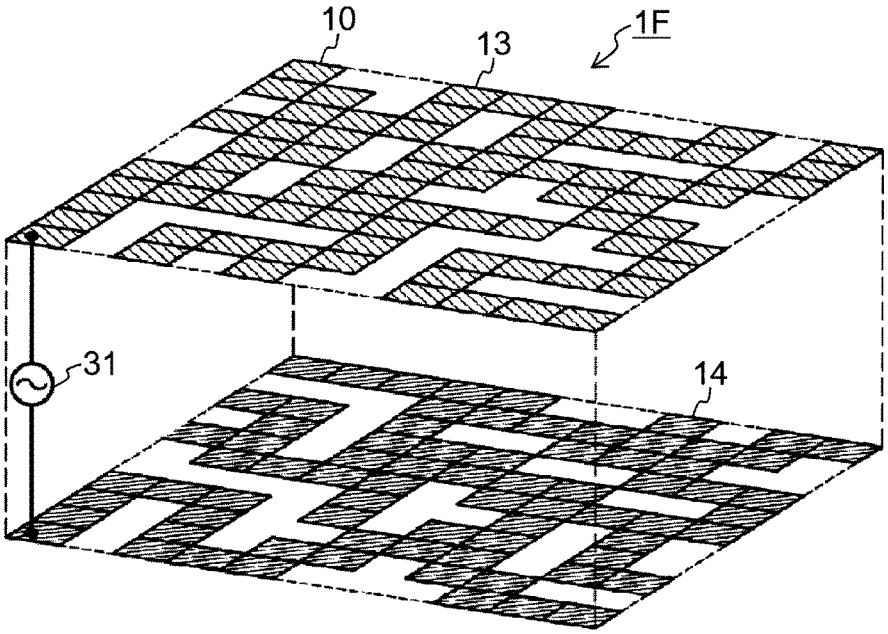
[FIG. 13]
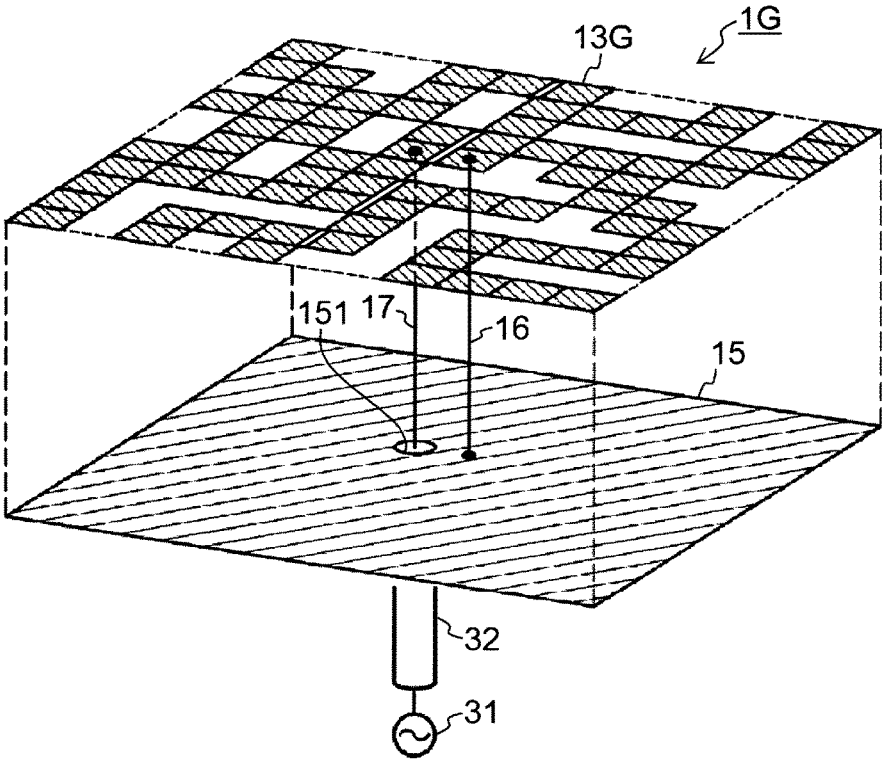

[FIG. 14]
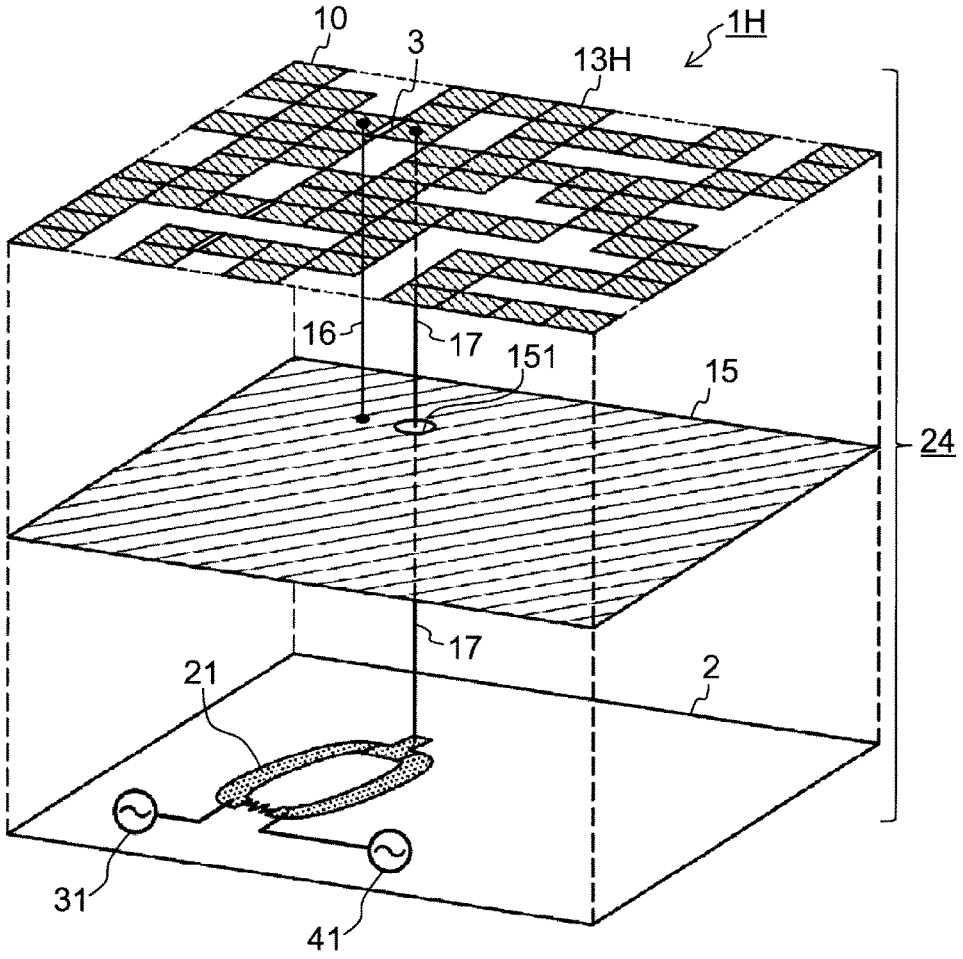

[FIG. 15]
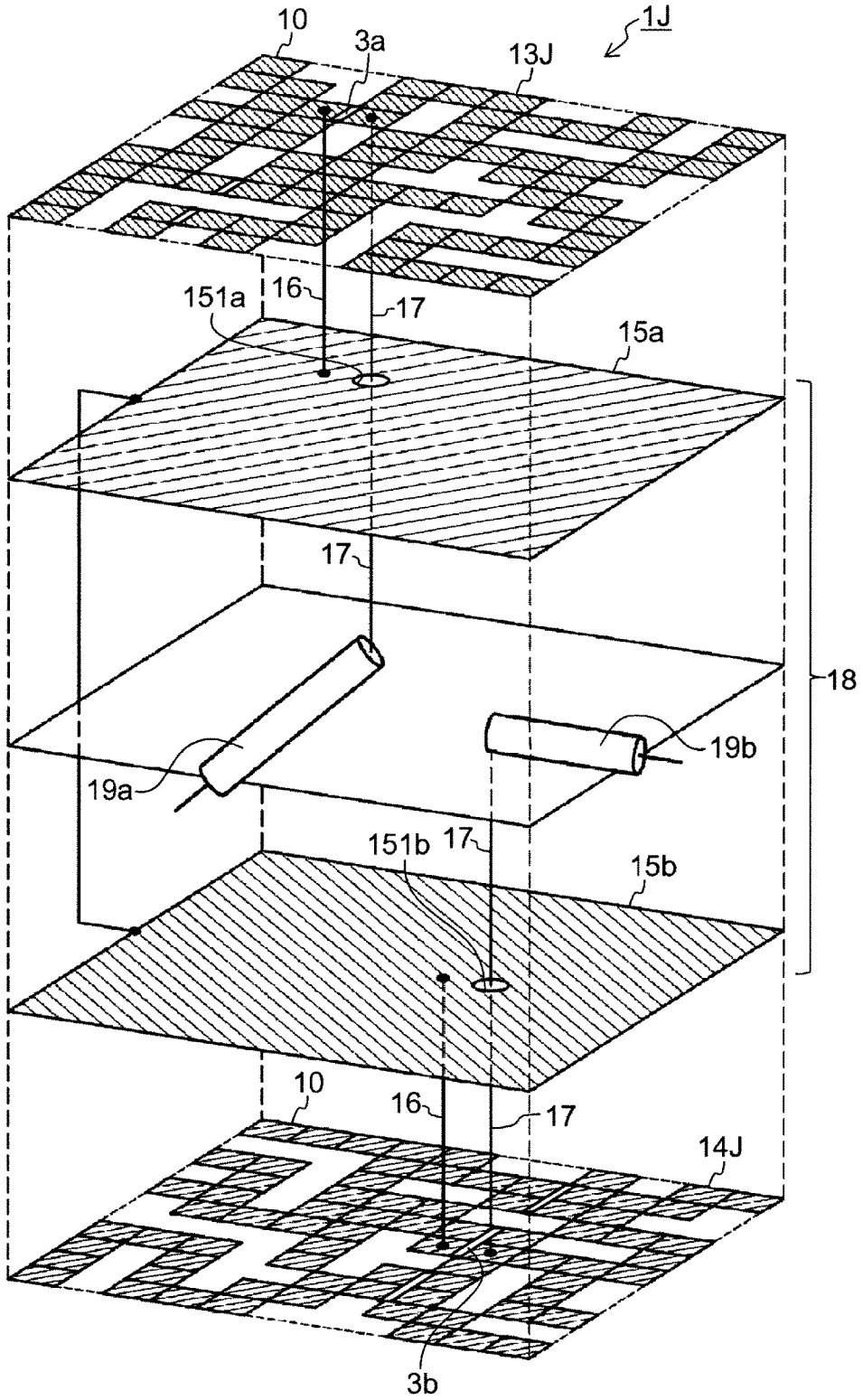

[FIG. 16]
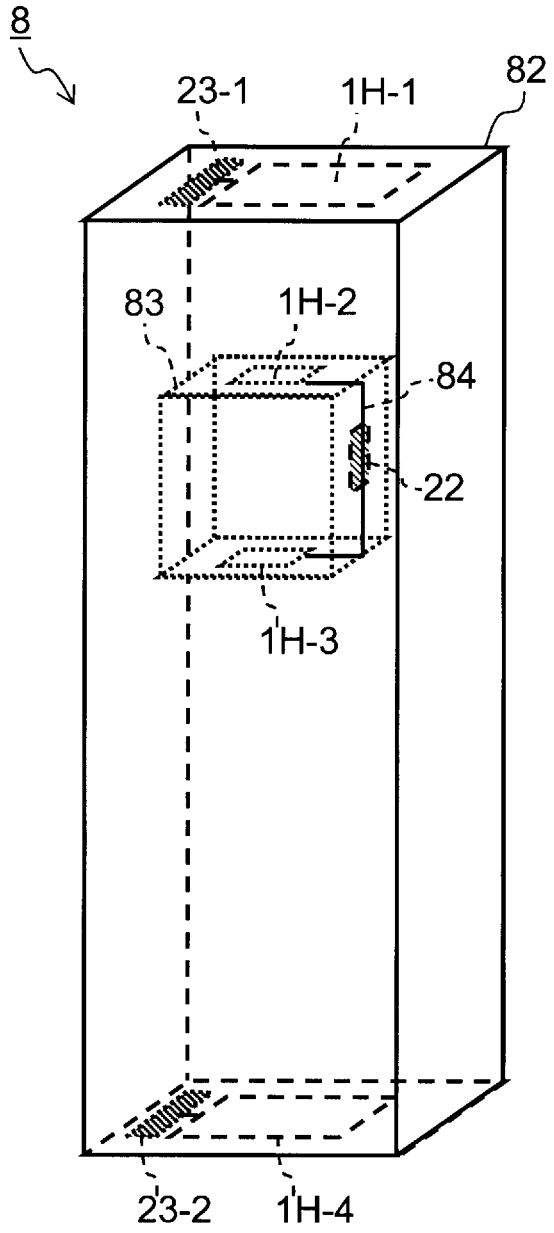

[FIG. 17]
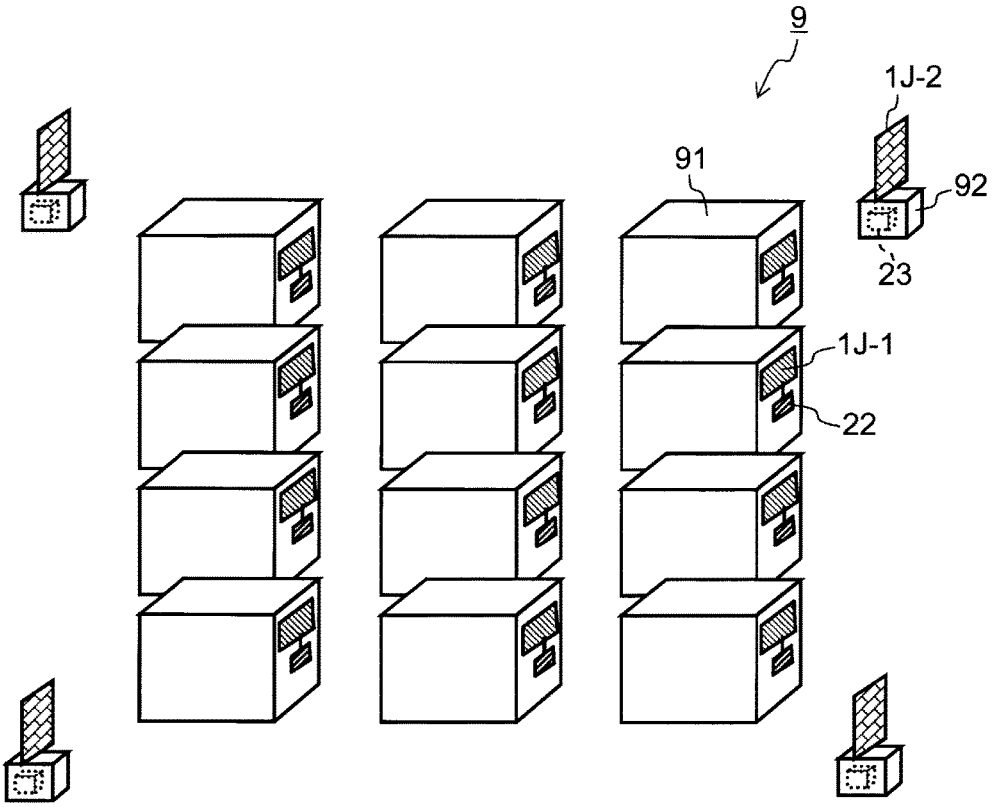

ROTATIONALLY POLARIZED ANTENNA, TRANSMISSION/RECEPTION MODULE, ELEVATOR CONTROL SYSTEM, AND SUBSTATION CONTROL SYSTEM

TECHNICAL FIELD

The present invention relates to a rotationally polarized antenna for emitting an electromagnetic wave which is a rotationally polarized wave rotating at a frequency lower than a propagation frequency, a transmission/reception module including the same, an elevator control system including the same, and a substation control system including the same.

BACKGROUND ART

A communication technology which enabled global diffusion of mobile phones has been used for conventional communication/broadcasting, and, in addition, the technology has been diligently researched and developed by relevant organizations to achieve a wireless network mainly intended to monitor/control a social infrastructure apparatus, which is required to perform highly reliable and highly secure communication.

In a controlling/monitoring network of social infrastructure apparatuses, in order to limit a communication service area within an area of an infrastructure system and in order not to interrupt operation of apparatuses constituting the infrastructure system, it is desired to constitute a mesh network in which wireless devices placed in the respective apparatuses communicate with each other.

In the mesh network, it is difficult to have a remarkable difference in height between a transmitter station and a receiving station. Further, because electromagnetic waves emitted from the wireless devices are scattered by the apparatuses, communication is performed by using a multi-reflected wave which is a non-line-of-sight wave. The non-line-of-sight wave is received at a field strength which is generally lower than that of a line-of-sight wave. In communication using a plurality of non-line-of-sight waves, there is a possibility that a plurality of reflected-wave propagation paths having substantially the same propagation attenuation characteristic are formed between a transmission side and a reception side and distinctive communication is achieved by using those reflected-wave propagation paths.

An electromagnetic wave has a characteristic that receives rotation of an inherent polarization vector when the electromagnetic wave is reflected by a scatterer in relation to both a direction of a normal vector to a surface of the scatterer and a direction of a polarization vector entering the scatterer. In view of this characteristic, a receiving station can know a polarization direction of an electromagnetic wave emitted by a transmitter station and can also know a polarization direction of an electromagnetic wave received via a plurality of reflection propagation paths reaching this receiving station. It is possible to achieve special communication in which the plurality of propagation paths are recognized or selected on the basis of both the directions.

In order to achieve the above communication, it is necessary to change a polarization direction of an electromagnetic wave and achieve a device for detecting this polarization direction. As an electromagnetic wave whose polarization is rotated, a circularly polarized wave is known. In the circularly polarized wave, a rotation frequency of the polarized wave and a propagation frequency are the same. Generally, a frequency range of an electromagnetic wave for performing wireless communication using a non-line-of-sight wave is limited to several hundred MHz to several GHz. Thus, the rotation frequency of the circularly polarized wave also falls within a range of several hundred MHz to several GHz, and therefore an oversampling ratio of 4 to 8 or more for performing accurate digital signal processing cannot be obtained at several hundred MHz which is an operation frequency of present commercial digital signal processing devices. By using an electromagnetic wave in which a rotation frequency of a polarized wave is lower than a propagation frequency, a polarization angle of an electromagnetic wave having a frequency for performing favorable communication with the use of a non-line-of-sight wave can be controlled or detected in a commercial digital signal processing device. The above electromagnetic wave is referred to as a rotationally polarized electromagnetic wave, and, by using, for example, two electromagnetic waves having different frequencies, it is possible to form a special electromagnetic wave in which a rotation frequency of a polarized wave is a half of a difference between both the frequencies and a propagation frequency is a half of the sum of both the frequencies. The above special electromagnetic wave can be achieved by composing two circularly polarized waves having different frequencies and different rotational directions, and therefore it is required to achieve an antenna which simultaneously generates those two circularly polarized waves.

Regarding such a request, there is known a configuration in which two antennas which generate electromagnetic waves having different frequencies and different rotational directions are achieved by a microstrip antenna having a thickness and are stacked.

In Purpose of Abstract of PTL 1, there is described "to provide a shared microstrip antenna for two frequencies, which includes a circularly polarized patch antenna for transmission and a circularly polarized patch antenna for reception, has large isolation between a transmitting terminal and a receiving terminal, and has a simple feeder circuit configuration".

CITATION LIST

Patent Literature

PTL 1: JP-A-7-249933

SUMMARY OF INVENTION

Technical Problems

A microstrip antenna having a thickness has a three-dimensional structure and is not suitable when a wireless device including the antenna is placed on a surface of an apparatus constituting a social infrastructure system. A technique disclosed in PTL 1 switches circularly polarized waves having different frequencies and different rotational directions and individually generate the circularly polarized waves. PTL 1 does not disclose a technique for simultaneously generating the circularly polarized waves.

In view of this, an object of the invention is to provide a thin rotationally polarized antenna which performs highly reliable and highly secure wireless communication, a transmission/reception module including the same, an elevator control system including the same, and a substation control system including the same.

Solution to Problems

In order to solve the above problems, the first invention is a rotationally polarized antenna in which, in the case where a feeding point is provided in an integrated plate conductor and is excited at a first frequency and a second frequency different from the first frequency, matching with a feeding circuit is achieved in both a frequency band including the first frequency and a frequency band including the second frequency, current distribution formed in orthogonal directions on the plate at the first frequency has the same amplitude and has a phase difference of 90 degrees, current distribution formed in the same orthogonal directions on the plate at the second frequency has the same amplitude and has a phase difference of 90 degrees, and a phase of the current distribution at the first frequency and a phase of the current distribution at the second frequency have opposite directions.

The second invention is a transmission/reception module including: the rotationally polarized antenna; a first circuit excited at the first frequency; and a second circuit excited at the second frequency.

The third invention is an elevator control system to which a wireless device including the rotationally polarized antenna is applied.

The fourth invention is a substation control system to which a wireless device including the rotationally polarized antenna is applied.

Other means will be described in Description of Embodiments.

Advantageous Effects of Invention

According to the invention, it is possible to provide a thin rotationally polarized antenna which performs highly reliable and highly secure wireless communication, a transmission/reception module including the same, an elevator control system including the same, and a substation control system including the same.

BRIEF DESCRIPTION OF DRAWINGS

FIG. 1 is a configuration diagram of a rotationally polarized antenna in Embodiment 1.

FIG. 4 is a configuration diagram of a rotationally polarized antenna in Embodiment 2.

FIG. 6 is a configuration diagram of a rotationally polarized antenna in Embodiment 3.

FIG. 7 is a graph showing frequency characteristics of the rotationally polarized antenna in Embodiment 3.

FIG. 8 is a configuration diagram of a rotationally polarized antenna in a modification example of Embodiment 3.

FIG. 9 is a configuration diagram of a rotationally polarized antenna in Embodiment 4.

FIG. 10 is a graph showing frequency characteristics of the rotationally polarized antenna in Embodiment 4.

FIG. 11 is a configuration diagram of a rotationally polarized antenna in Embodiment 5.

FIG. 12 is a configuration diagram of a rotationally polarized antenna in Embodiment 6.

FIG. 13 is a configuration diagram of a rotationally polarized antenna in Embodiment 7.

FIG. 14 is a configuration diagram of a rotationally polarized antenna in Embodiment 8.

FIG. 15 is a configuration diagram of a rotationally polarized antenna in Embodiment 9.

FIG. 16 is a configuration diagram of an elevator system in Embodiment 10.

FIG. 17 is a configuration diagram of a substation system in Embodiment 11.

DESCRIPTION OF EMBODIMENTS

Figure 2A:
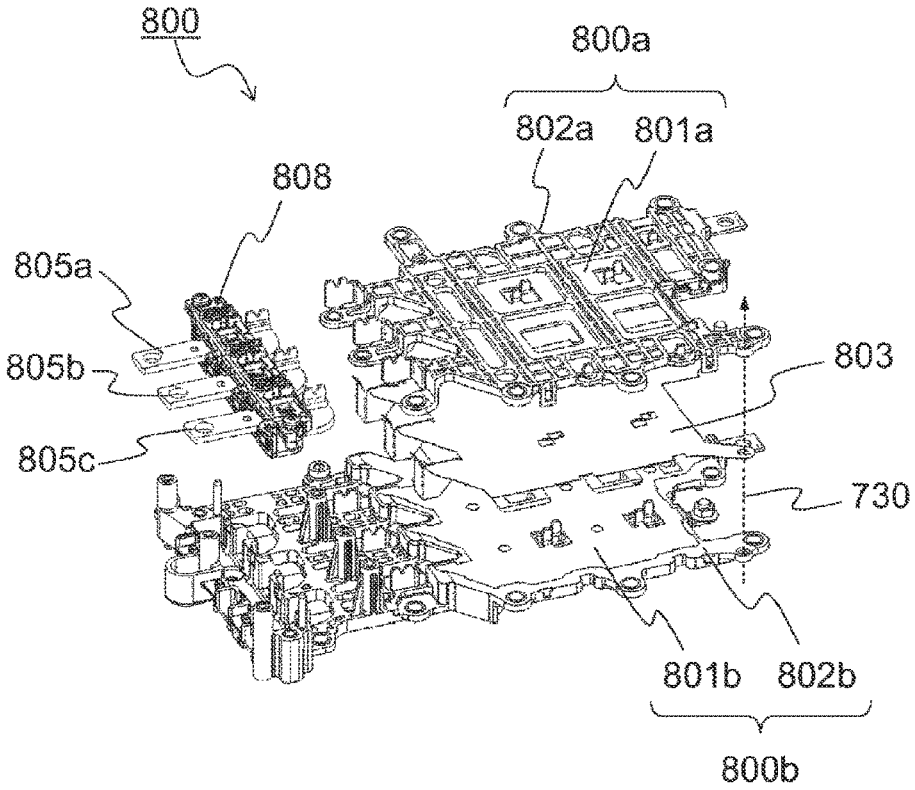
FIG. 2 is a graph showing frequency characteristics of the rotationally polarized antenna in Embodiment 1.

Hereinafter, embodiments of the invention will be described in detail with reference to the drawings.

Embodiment 1

This embodiment relates to an antenna 1 which can transmit and receive a rotationally polarized wave. A configuration and operation of the antenna 1 of this embodiment will be described with reference to FIG. 1 to FIG. 3.

FIG. 1 is an exemplary configuration diagram of the antenna 1 which can transmit and receive a rotationally polarized wave in Embodiment 1.

In the thin antenna 1, a rectangular area determined in advance is divided into rectangular minute areas. A structure of the antenna 1 is determined depending on whether or not a minute conductor segment 10 exists in each area. An intermediate side between two particular adjacent minute conductor segments 10 is electrically cut and a gap is formed. This gap serves as a feeding point 3. Another intermediate side between two adjacent minute conductor segments 10 at a different position is electrically cut and a gap is formed. This gap serves as a feeding point 4. Note that the configuration of the antenna 1 in FIG. 1 is a simplified example for showing a concept of the invention and is not actual arrangement of the minute conductor segments 10.

Orthogonal components Ix and Iy of current distribution are formed in the rectangular area by a characteristic conductor pattern formed by the plurality of minute conductor segments 10 and the feeding points 3 and 4. When a high-frequency signal having a frequency f1 (first frequency) is input to the antenna 1 via the feeding point 3, the components Ix and Iy of the current distribution have substantially the same amplitude and are different in phase by +90 degrees. When a high-frequency signal having a frequency f2 (second frequency) is input to the antenna 1 via the feeding point 4, the components Ix and Iy of the current distribution have substantially the same amplitude and are different in phase by −90 degrees. Thus, circularly polarized waves and a rotationally polarized wave shown in FIG. 3 described below are generated.

Figure 2B:
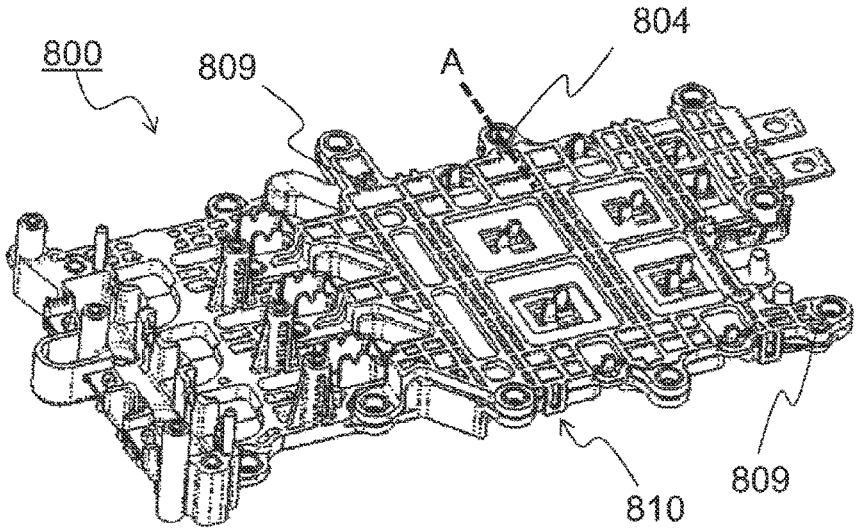

FIG. 2 is a graph showing frequency characteristics of the rotationally polarized antenna in Embodiment 1. A vertical axis indicates return loss. A horizontal axis indicates frequency.

A favorable impedance matching state with a high-frequency circuit for supplying a high-frequency signal to the antenna 1 is achieved at the feeding point 3 in the whole area including the frequency f1 and a frequency band (2Δf) of a signal superimposed on an electromagnetic wave having the frequency. A favorable impedance matching state with the high-frequency circuit for supplying a high-frequency signal to the antenna 1 is achieved at the feeding point 4 in the whole area including the frequency f2 and a frequency band (2Δf) of a signal superimposed on an electromagnetic wave having the frequency. Herein, a favorable impedance matching state with a high-frequency circuit in a predetermined frequency band indicates that a frequency characteristic is smaller than predetermined return loss Rm.

According to this embodiment, a high-frequency signal having the frequency f1 and a high-frequency signal having the frequency f2 to be input to the antenna 1 can be input via the different feeding points 3 and 4. Therefore, a circuit for composing high-frequency signals having the frequencies f1 and f2 can be removed from the high-frequency circuit for supplying a signal to the antenna 1. This makes it possible to reduce a size and costs of the whole wireless device to which the antenna of the invention is provided.

Figure 3A:
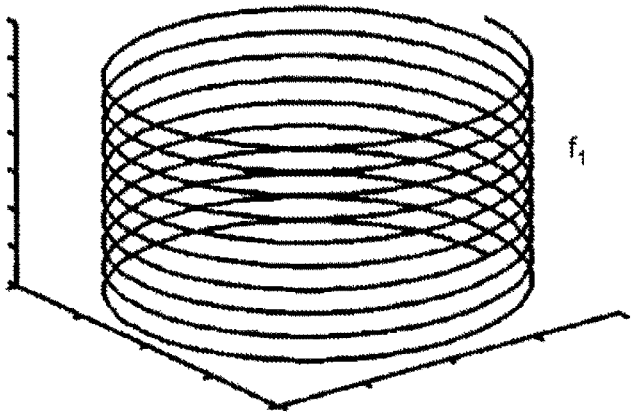
FIGS. 3A to 3C are perspective views showing circularly polarized waves and a rotationally polarized wave each of which has a spatial/time waveform.
Figure 3B:
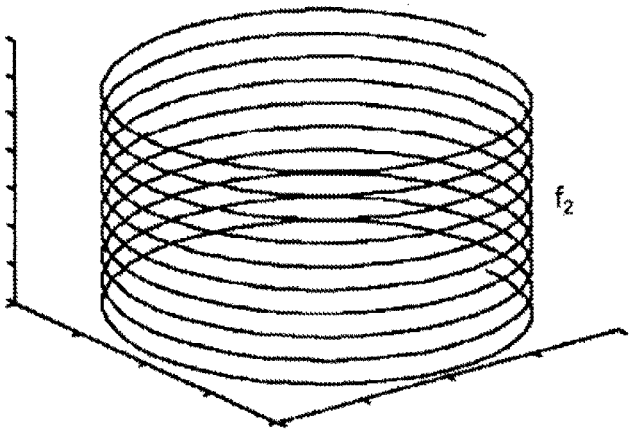
Figure 3C:
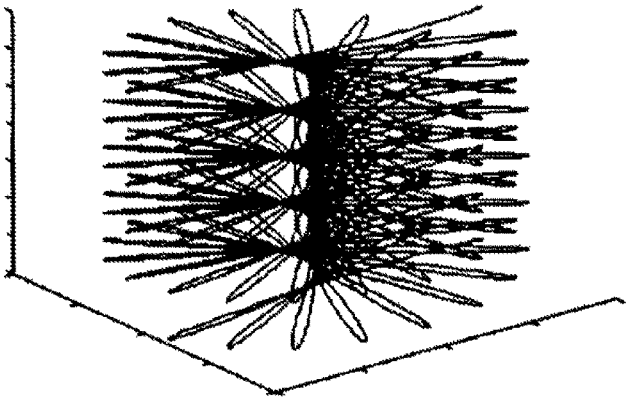
Figure 5A:
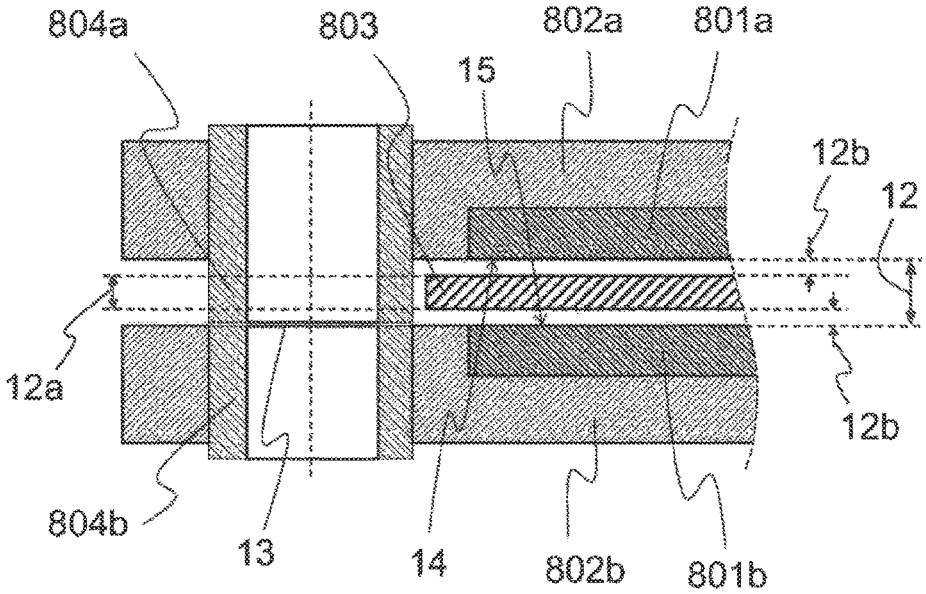
FIG. 5 is a graph showing frequency characteristics of the rotationally polarized antenna in Embodiment 2.
Figure 5B:
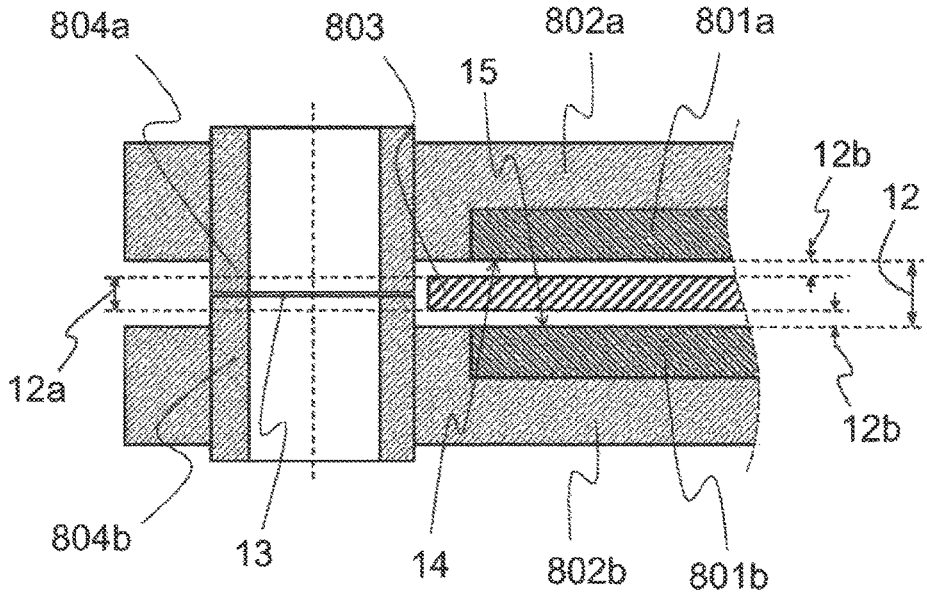
Figure 5C:
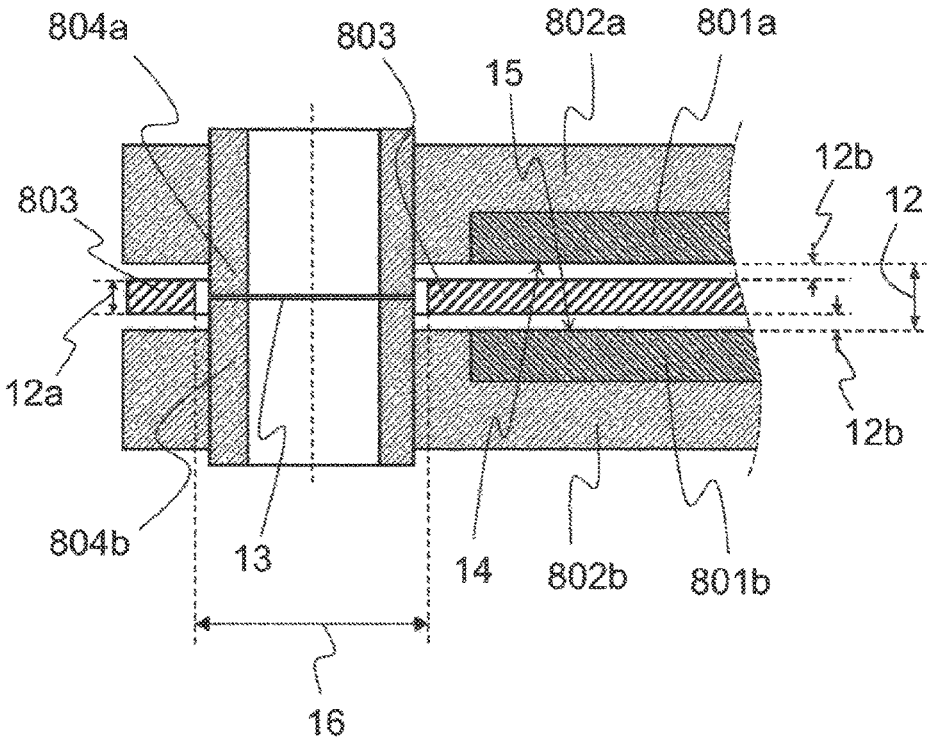
Figure 5D:
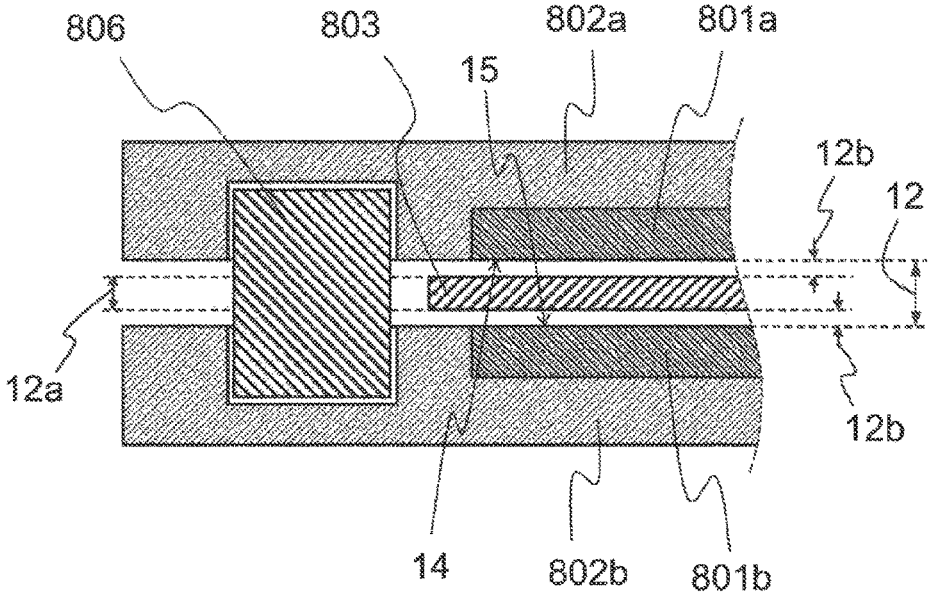
Figure 5E:
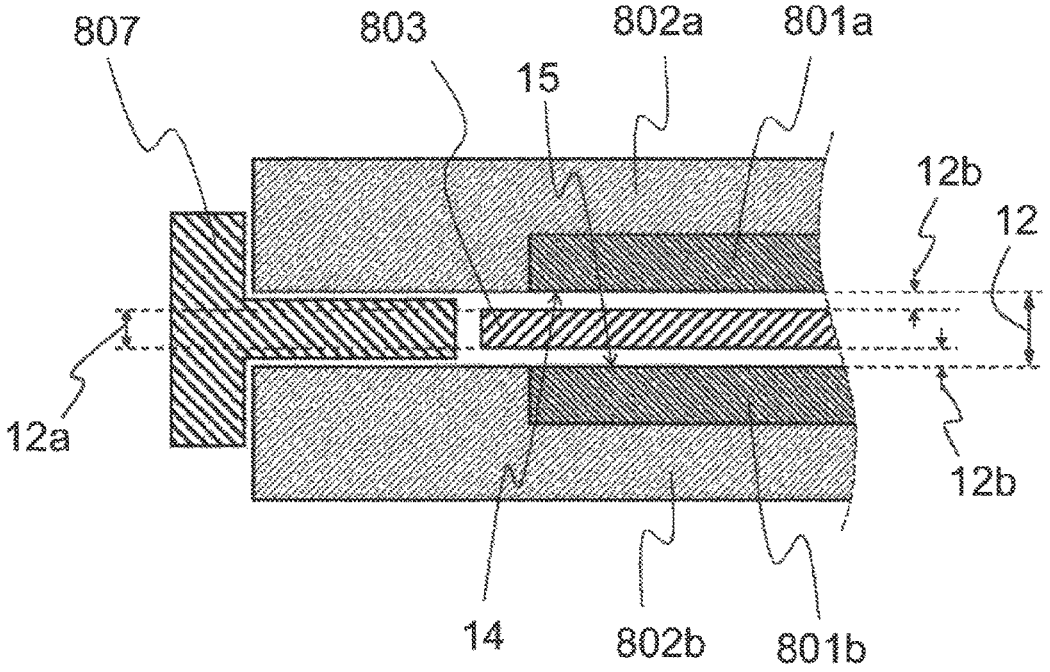

FIGS. 3(*a*) to 3(*c*) are perspective views showing circularly polarized waves and a rotationally polarized wave each of which has a spatial/time waveform, which are expressed by expressions (1) to expressions (3).

Two-dimensional current distribution is generated on an integrated conductor structure including a plurality of minute segments. Specific distribution is inherent to each conductor pattern and a position of a feeding point. A circularly polarized wave has a characteristic that orthogonal components of a propagated electromagnetic wave have a phase difference of 90 degrees. Orthogonal components of current distribution on the conductor structure are in proportion to a far field formed by the components, and therefore, in the case where the orthogonal components of the current distribution on the conductor structure have a phase difference of 90 degrees, a circularly polarized wave is emitted toward the air.

FIG. 3(*a*) shows a circularly polarized wave rotating in a right direction at the frequency f1. This circularly polarized wave is expressed by the expressions (1).

[Math. 1]

$$x=\cos(2\pi f_1 t)$$

$$y=\sin(2\pi f_1 t) \quad (1)$$

FIG. 3(*b*) shows a circularly polarized wave rotating in an opposite direction at the frequency f2. This circularly polarized wave is expressed by the expressions (2).

[Math. 2]

$$x=\cos(2\pi f_2 t)$$

$$y=-\sin(2\pi f_2 t) \quad (2)$$

FIG. 3(*c*) shows a rotationally polarized wave formed by composing those circularly polarized waves. This circularly polarized wave is expressed by the expressions (3).

[Math. 3]

$$x=\cos(2\pi f_1 t)+\cos(2\pi f_2 t)$$

$$y=\sin(2\pi f_1 t)-\sin(2\pi f_2 t) \quad (3)$$

As is clear from FIG. 3(*c*), the rotationally polarized wave has a form in which, when a polarized wave is helically oscillated at a frequency which is a half of the sum of two frequencies in a direction perpendicular to a propagation direction and an envelop thereof is taken, the envelop rotates at a frequency which is a half of a difference between the two frequencies.

Therefore, in the case where a conductor pattern and positions of feeding points are found out so that orthogonal components of current distribution have a phase difference of 90 degrees, such a structure thus found out is an antenna structure to be obtained. The structure can be specifically selected by using an appropriate search algorithm (for example, round-robin algorithm) from all combinations of presence/absence of minute rectangular segments into which a finite rectangular area determined in advance is divided. According to the invention, it is possible to achieve an electromagnetic wave whose polarization is rotated at a frequency lower than a frequency of a carrier wave at an order level with a thin-plate like structure which can be used for providing a small wireless device placeable on a surface of an infrastructure apparatus, and therefore it is possible to detect deviation of a polarization angle of a reception electromagnetic wave from a polarization angle of a transmission electromagnetic wave by using a commercial digital signal processing device. This makes it possible to achieve highly reliable and highly secure wireless communication using a plurality of propagation paths formed by multi-reflection between a transmission side and a reception side.

Embodiment 2

In this embodiment, another configuration example of the antenna which can transmit and receive a rotationally polarized wave in the invention will be described with reference to FIG. 4 and FIG. 5.

FIG. 4 is an exemplary configuration diagram of an antenna 1A which can transmit and receive a rotationally polarized wave in this embodiment.

In the antenna 1A (rotationally polarized antenna), a rectangular area having a square shape, which is determined in advance, is divided into rectangular minute areas, and a configuration thereof is determined depending on whether or not a minute conductor segment 10 exists in each area.

An intermediate side between two adjacent minute conductor segments 10 is electrically cut and a gap is formed. This gap serves as a feeding point 3. Orthogonal components Ix and Iy of current distribution are formed in the rectangular area by a characteristic conductor pattern formed by the plurality of minute conductor segments 10 and the feeding point 3. The components Ix and Iy of the current distribution have substantially the same amplitude and are different in phase by +90 degrees at a frequency f1 (first frequency) and have substantially the same amplitude and are different in phase by −90 degrees at a frequency f2 (second frequency).

FIG. 5 is a graph showing frequency characteristics of the rotationally polarized antenna 1A which can transmit and receive a rotationally polarized wave in Embodiment 1. A vertical axis of FIG. 5 indicates return loss. A horizontal axis of FIG. 5 indicates frequency. A solid line indicates return loss of a signal having the frequency f1. A broken line indicates return loss of a signal having the frequency f2.

A favorable impedance matching state with a high-frequency circuit for supplying a high-frequency signal to the antenna 1A is achieved at the feeding point 3 in the whole area including the frequency f1, the frequency f2, and a frequency band (2Δf) of signals superimposed on electromagnetic waves having the frequencies.

According to this embodiment, a high-frequency signal supplied from a high-frequency circuit can be efficiently emitted toward a space at the feeding point 3 with the use of a circularly polarized wave rotating in a right direction at the frequency f1, and, in the same time, a high-frequency signal supplied from the high-frequency circuit can be efficiently emitted toward the space thereat with the use of a circularly polarized wave rotating in a left direction at the frequency f2. As a result, an electromagnetic wave in which a rotation frequency of a polarized wave is lower than a propagation frequency of a radio wave can be emitted toward the space.

Embodiment 3

In this embodiment, another configuration example of the antenna which can transmit and receive a rotationally polarized wave in the invention will be described with reference to FIG. 6 and FIG. 7.

FIG. 6 is an exemplary configuration diagram of an antenna 1B which can transmit and receive a rotationally polarized wave in Embodiment 3.

In the antenna 1B, a rectangular area determined in advance is divided into two partial rectangular areas and each of the partial rectangular areas is divided into rectangular minute areas. An antenna structure 11 is determined depending on whether or not minute conductor segments 10 exist in one partial rectangular use area. An intermediate side between two particular adjacent minute conductor segments 10 of the antenna structure 11 is electrically cut and a gap is formed. This gap serves as a feeding point 3. An antenna structure 12 is determined depending on whether or not minute conductor segments 10 exist in the other partial rectangular area. An intermediate side between two particular adjacent minute conductor segments 10 of the antenna structure 12 is electrically cut and a gap is formed. This gap serves as a feeding point 4.

The antenna structures 11 and 12 are apposed on a dielectric sheet 7 to form the antenna 1B. Orthogonal components Ix1 and Iy1 of current distribution and orthogonal components Ix2 and Iy2 of current distribution are formed in the respective partial rectangular areas by characteristic conductor patterns formed by the plurality of minute conductor segments 10 and the feeding points 3 and 4.

When a high-frequency signal having a frequency f1 is input to the antenna 1B via the feeding point 3, the components Ix1 and Iy1 of the current distribution, which have substantially the same amplitude and are different in phase by +90 degrees, are formed. When a high-frequency signal having a frequency f2 is input to the antenna 1B via the feeding point 4, the components Ix2 and Iy2 of the current distribution, which have substantially the same amplitude and are different in phase by −90 degrees, are formed.

FIG. 7 is a graph showing frequency characteristics of the rotationally polarized antenna in Embodiment 3. A vertical axis of FIG. 7 indicates return loss. A horizontal axis of FIG. 7 indicates frequency.

A favorable impedance matching state with a high-frequency circuit for supplying a high-frequency signal to the antenna 1B is achieved at the feeding point 3 in the whole area including the frequency f1 and a frequency band (2Δf) of a signal superimposed on an electromagnetic wave having the frequency, and a favorable impedance matching state with the high-frequency circuit for supplying a high-frequency signal to the antenna 1B is achieved at the feeding point 4 in the whole area including the frequency f2 and a frequency band (2Δf) of a signal superimposed on an electromagnetic wave having the frequency.

According to this embodiment, it is possible to individually design the antenna structure 11 operated at the frequency f1 and the antenna structure 12 operated at the frequency f2, and therefore the structure of the antenna 1B bringing about a similar effect to that of the antenna 1A in Embodiment 2 can be made more easily. This makes it possible to reduce man-hours of an antenna.

Design Example of Embodiment 3

In this embodiment, a specific design example of an antenna which can transmit and receive a rotationally polarized wave in the invention will be described with reference to FIG. 8.

FIG. 8 shows a design example of a specific conductor pattern of an antenna 1C which can transmit and receive a rotationally polarized wave in Embodiment 3.

The frequency f1 of a high-frequency signal supplied to the antenna 1C is 426 [MHz]. The frequency f2 of this high-frequency signal is 429 [MHz]. A shape of the minute conductor segment 10 is square having a side length of 5 [mm].

This design example achieves a favorable impedance matching condition in which VSWR (Voltage Standing Wave Ratio) is less than 2 at both the frequencies. With this embodiment, the conductor pattern can be specifically selected by using an appropriate search algorithm (for example, round-robin algorithm) from all combinations of presence/absence of minute conductor segments 10 into which a finite rectangular area determined in advance is divided. Therefore, it is possible to specifically design the antenna 1C which emits, toward a space, an electromagnetic wave whose polarization is rotated at a rotation frequency lower than a propagation frequency of a radio wave.

Embodiment 4

In this embodiment, another configuration example of the antenna which can transmit and receive a rotationally polarized wave in the invention will be described with reference to FIG. 9.

FIG. 9 shows another exemplary configuration diagram of the antenna which can transmit and receive a rotationally polarized wave in Embodiment 4.

In an antenna 1D of Embodiment 4, an antenna structure 11D which is the antenna 1A of Embodiment 2 as it is and an antenna structure 12D obtained by reversing the antenna 1A of Embodiment 2 are apposed on a dielectric sheet 7. The antenna structure 11D includes feeding points 3 and 4. The antenna structure 12D includes feeding points 5 and 6.

FIG. 10 is a graph showing frequency characteristics of the rotationally polarized antenna in Embodiment 4. A vertical axis of FIG. 10 indicates return loss. A horizontal axis of FIG. 10 indicates frequency.

As indicated by a thick solid line a, a favorable impedance matching state with a high-frequency circuit for supplying a high-frequency signal to the antenna structure 11D is achieved at the feeding point 3 in the whole area including the frequency f1 and a frequency band (2Δf) of a signal superimposed on an electromagnetic wave having the frequency.

As indicated by a thick broken line c, a favorable impedance matching state with the high-frequency circuit for supplying a high-frequency signal to the antenna structure 11D is achieved at the feeding point 4 in the whole area including the frequency f2 and a frequency band (2Δf) of a signal superimposed on an electromagnetic wave having the frequency.

As indicated by a thin solid line b, a favorable impedance matching state with a high-frequency circuit for supplying a high-frequency signal to the antenna structure 12D is achieved at the feeding point 5 in the whole area including the frequency f1 and a frequency band (2Δf) of a signal superimposed on an electromagnetic wave having the frequency.

As indicated by a thin broken line d, a favorable impedance matching state with the high-frequency circuit for supplying a high-frequency signal to the antenna structure 12D is achieved at the feeding point 6 in the whole area including the frequency f2 and a frequency band (2Δf) of a signal superimposed on an electromagnetic wave having the frequency.

The antenna structure 11D and the antenna structure 12D generate circularly polarized waves rotating at the same frequency in opposite directions. The antenna structure 11D and the antenna structure 12D can individually generate respective circularly polarized waves even in the case where the antenna structure 11D and the antenna structure 12D are closely arranged. The antenna 1D can simultaneously emit rotationally polarized waves in different rotation directions toward the air or switchably emit the rotationally polarized waves toward the air with an integrated antenna structure. This makes it possible to achieve polarization diversity using rotationally polarized waves.

Embodiment 5

In this embodiment, another configuration example of the antenna which can transmit and receive a rotationally polarized wave in the invention will be described with reference to FIG. 11.

FIG. 11 is an exemplary configuration diagram of an antenna which can transmit and receive a rotationally polarized wave in Embodiment 5.

In an antenna 1E, a rectangular area determined in advance is divided into two areas, i.e., a central rectangular area positioned in the center and an O-shaped peripheral area surrounding the central rectangular area, and each of the areas is divided into rectangular minute areas.

An antenna structure 12E is determined depending on whether or not minute conductor segments 10 exist in the central rectangular area. An intermediate side between two adjacent minute conductor segments 10 is electrically cut and a gap is formed. This gap serves as a feeding point 4. An antenna structure 11E is determined depending on whether or not the minute conductor segments 10 exist in the other partial rectangular use area. An intermediate side between two adjacent minute conductor segments 10 is electrically cut and a gap is formed. This gap serves as a feeding point 3. The antenna structure 11E and the antenna structure 12E are arranged on a dielectric sheet 7 so that the antenna structure 11E surrounds the antenna structure 12E so as not to be brought into electrical contact with the antenna structure 12E. Thus, the antenna 1E is formed.

Two orthogonal components of current distribution in the central rectangular area and two orthogonal components thereof in the peripheral area surrounding the central area are formed by characteristic conductor patterns formed by the plurality of minute conductor segments 10, the feeding point 3, and the feeding point 4. When a high-frequency signal having a frequency f1 is input via the feeding point 3, components Ix1 and Iy1 of the current distribution, which have substantially the same amplitude and are different in phase by +90 degrees, are formed. When a high-frequency signal having a frequency f2 is input via the feeding point 4, components Ix2 and Iy2 of the current distribution, which have substantially the same amplitude and are different in phase by −90 degrees, are formed.

A favorable impedance matching state with a high-frequency circuit for supplying a high-frequency signal to the antenna 1E is achieved at the feeding point 3 in the whole area including the frequency f1 and a frequency band (2Δf) of a signal superimposed on an electromagnetic wave having the frequency. A favorable impedance matching state with the high-frequency circuit for supplying a high-frequency signal to the antenna 1E is achieved at the feeding point 4 in the whole area including the frequency f2 and a frequency band (2Δf) of a signal superimposed on an electromagnetic wave having the frequency.

According to this embodiment, it is possible to bring about the similar effect to that of Embodiment 3. In comparison with Embodiment 3, central axes of the two antenna structures operated at different frequencies correspond to each other, and therefore it is possible to maintain circularity of rotation of a polarized wave with respect to a direction deviated from the central axes of the antennas.

Embodiment 6

In this embodiment, a structure example of an antenna which can transmit and receive a rotationally polarized wave in the invention will be described with reference to FIG. 12.

FIG. 12 is an exemplary structure diagram of an antenna 1F which can transmit and receive a rotationally polarized wave in Embodiment 6.

The antenna 1F includes an upper structure 13 which is an integrated plate structure and the lower structure 14 which is an integrated plate structure. The upper structure 13 and the lower structure 14 include a plurality of square minute conductor segments 10. The upper structure 13 and the lower structure 14 spatially face each other and are excited at a feeding point 31. The feeding point 31 needs to be a satisfactorily small clearance with respect to an excitation wavelength. Note that FIG. 12 separately shows the upper structure 13 and the lower structure 14 in order to clearly show a relationship between the upper structure 13 and the lower structure 14.

Herein, the clearance of the feeding point 31 is less than one hundredth of the excitation wavelength. Therefore, in the case where the upper structure 13 and the lower structure 14 are separated and do not satisfy the above condition, the feeding point 31 and the upper structure 13 and the lower structure 14 may be electrically connected by a linear conductor.

According to this embodiment, it is possible to increase the number of minute conductor segments 10 while keeping a thin shape and preventing increase in a volume of the antenna. Thus, it is possible to increase the kind of aggregations including the plurality of minute conductor segments 10. This increases the degree of freedom to search an antenna structure for generating a desired rotationally polarized wave. As a result, when this antenna is designed, it is possible to reduce a search time of an antenna structure satisfying specifications. This makes it possible to reduce design man-hours of a rotationally polarized antenna.

Embodiment 7

In this embodiment, another structure example of the antenna which can transmit and receive a rotationally polarized wave in the invention will be described with reference to FIG. 13.

FIG. 13 is another exemplary structure diagram of the antenna which can transmit and receive a rotationally polarized wave in Embodiment 7.

An antenna 1G having an integrated plate structure includes a plurality of square minute conductor segments 10. The antenna 1G is placed to face a conductor plate 15. The conductor plate 15 has a feeding hole 151, and a linear conductor 17 forming an inner conductor of a coaxial line 32 passes through the feeding hole 151.

A clearance formed between two particular adjacent minute conductor segments 10 of the antenna 1G serves as a feeding point 3, and the linear conductor 17 forming the inner conductor of the coaxial line 32 is electrically connected to one minute conductor segment 10 connected to the feeding point 3. The other minute conductor segment 10 connected to the feeding point 3 is connected to the conductor plate 15 via a linear conductor 16, and an external conductor of the coaxial line 32 is electrically connected at an edge of the feeding hole 151 of the conductor plate 15. A signal of a high-frequency signal generation circuit 31 is supplied to the antenna 1G via the coaxial line 32.

According to this embodiment, a part of electromagnetic waves emitted from the antenna 1G, the part being emitted toward the conductor plate 15, is reflected by the conductor plate 15 and is emitted again in a direction opposite to a direction toward the conductor plate 15, which is seen from the antenna 1G. Therefore, a high-frequency signal supplied via the feeding point 3 is emitted in one direction. This makes it possible to improve a gain of the antenna 1G. It is also possible to reduce an influence upon an emission characteristic of an antenna of an apparatus which is an object existing in a direction in which the antenna 1G does not emit an electromagnetic wave, i.e., an electromagnetic wave scatterer on which, for example, a high-frequency circuit and a wireless device are placed, and it is possible to improve sensitivity of the wireless device and contribute to stable operation.

Embodiment 8

In this embodiment, another structure example of the antenna which can transmit and receive a rotationally polarized wave in the invention will be described with reference to FIG. 14.

FIG. 14 is another exemplary structure diagram of the antenna which can transmit and receive a rotationally polarized wave in this embodiment.

An antenna 1H having an integrated plate structure includes a plurality of square minute conductor segments 10. The antenna 1H is placed to face a conductor plate 15. The conductor plate 15 has a feeding hole 151, and a clearance formed between two particular adjacent minute conductor segments 10 of the antenna 1H serves as a feeding point 3. A surface of the conductor plate 15 which does not face the antenna 1H is backed with a dielectric layer. A flat-surface composition circuit 21 is formed on a substrate 2 facing the conductor plate 15 backed with the dielectric layer. A composition output point of the flat-surface composition circuit 21 is electrically connected to one minute conductor segment 10 connected to the feeding point 3 via the linear conductor 17. The other minute conductor segment 10 connected to the feeding point 3 is connected to the conductor plate 15 via the linear conductor 16. A high-frequency signal generation circuit 31 (first circuit) for generating a high-frequency signal having a frequency f1 and a high-frequency signal generation circuit 41 (second circuit) for generating a high-frequency signal having a frequency f2 are connected to two input points of the flat-surface composition circuit 21. The antenna 1H, the flat-surface composition circuit 21, and the high-frequency signal generation circuits 31 and 41 constitute a transmission/reception module 24.

According to this embodiment, a high-frequency signal having the frequency f1 and a high-frequency signal having the frequency f2 are composed by the flat-surface composition circuit 21 and the composed signal is supplied via the feeding point 3 of the antenna 1H. Thus, a composition circuit can be removed from a high-frequency circuit of a wireless device for supplying a signal to the antenna 1H. This makes it possible to reduce a size and costs of a wireless device to which the antenna of the invention is applied.

Embodiment 9

In this embodiment, another structure example of the antenna which can transmit and receive a rotationally polarized wave in the invention will be described with reference to FIG. 15.

FIG. 15 is another exemplary structure diagram of the antenna which can transmit and receive a rotationally polarized wave in this embodiment.

An antenna structure 13J having an integrated plate structure includes a plurality of square minute conductor segments 10. The antenna structure 13J is placed to face a conductor plate 15*a*. The conductor plate 15*a* has a feeding hole 151*a*. A clearance formed between two particular adjacent minute conductor segments 10 of the antenna structure 13J serves as a feeding point 3*a*.

An antenna structure 14J having an integrated plate structure includes a plurality of square minute conductor segments 10. The antenna structure 14J is placed to face a conductor plate 15*b*. The conductor plate 15*b* has a feeding hole 151*b*. A clearance formed between two particular adjacent minute conductor segments 10 of the antenna structure 14J serves as a feeding point 3*b*.

The conductor plate 15*a* and the conductor plate 15*b* are apposed to face each other, and an intermediate layer 18 having a flat-surface shape is formed therebetween. A feeding strip line 19*a* and a feeding strip line 19*b* are formed on the intermediate layer 18.

The feeding strip line 19*a* is electrically connected to one minute conductor segment 10 connected to the feeding point 3*a* via the linear conductor 17. The other minute conductor segment 10 connected to the feeding point 3*b* is connected to the conductor plate 15 via the linear conductor 16.

The feeding strip line 19*b* is electrically connected to one minute conductor segment 10 connected to the feeding point 3*b* via the linear conductor 17. The other minute conductor segment 10 connected to the feeding point 3*b* is electrically connected to the conductor plate 15*b* via the linear conductor 16.

The conductor plate 15*a* and the conductor plate 15*b* are connected to have the same electrical potential. The intermediate layer 18 is formed as an inner layer by filling a dielectric layer between the intermediate layer 18 and the conductor plate 15*a* and filling a dielectric layer between the intermediate layer 18 and the conductor plate 15*b*.

According to this embodiment, in an antenna 1J having a thin-plate like structure, electromagnetic waves emitted from the antenna structure 13J and the antenna structure 14J on both sides of this plate structure can be emitted toward different half planes with a little interference. In other words, it is possible to individually emit electromagnetic waves which are polarized waves rotating in the same direction or different directions on the both sides of the antenna 1J having a thin-plate like structure. It is possible to improve the degree of freedom in design of a wireless network including a wireless device to which the antenna 1J of the invention is provided and using a rotationally polarized wave as an electromagnetic wave.

Embodiment 10

In this embodiment, a configuration example of a wireless communication system including antennas which can transmit and receive a rotationally polarized wave in the invention and using a rotationally polarized wave as an electromagnetic wave will be described.

FIG. 11 is a configuration diagram of an elevator system in Embodiment 10.

In an elevator system 8, an ascending/descending car 83 ascends and descends in a building 82. Rotationally polarized antennas 1H-1 and 1H-4 which can transmit and receive rotationally polarized waves in the invention and wireless devices 23-1 and 23-2 serving as base stations including the rotationally polarized antennas, respectively, are placed on a ceiling portion and a floor portion in the building 82.

Rotationally polarized antennas 1H-2 and 1H-3 which can transmit and receive rotationally polarized waves are placed on an external ceiling and an external floor surface of the ascending/descending car 83 and are connected to a wireless device 22 serving as a terminal station with the use of a high-frequency cable 84.

The wireless devices 23-1 and 23-2 serving as the base stations and the wireless device 22 serving as the terminal station use the inside of the building 82 as a wireless transmission medium, and therefore electromagnetic waves are subjected to multi-reflection by an inner wall of the building 82 and an external wall of the ascending/descending car 83. Thus, a multi-path interference environment is formed.

In this embodiment, it is possible to achieve high-quality wireless transmission which compensates reduction in communication quality between a transmission side and a reception side with the use of a plurality of reflected waves in the multi-path interference environment. Therefore, the elevator system 8 can be remotely controlled/monitored from the building 82 with the use of wireless connecting means including the wireless devices instead of wired connecting means. Thus, it is possible to remove the wired connecting means such as a cable. This makes it possible to achieve the same transportability in a smaller building volume or improve transportability by increasing a size of the elevator in the same building volume.

Embodiment 11

In this embodiment, another configuration example of the wireless communication system including antennas which can transmit and receive a rotationally polarized wave in the invention and using a rotationally polarized wave as an electromagnetic wave will be described.

FIG. 12 is an exemplary configuration diagram of a transformation facility monitoring system 9 to which a wireless device including a transmitter and a receiver of a wireless communication system including antennas which can transmit and receive a rotationally polarized wave in this embodiment and using a rotationally polarized wave as an electromagnetic wave is applied.

The transformation facility monitoring system 9 of this embodiment includes a plurality of transformers 91 and a plurality of base station devices 92. In each of the transformer 91, a wireless device 22 serving as a terminal station including a transmitter and a receiver of a wireless communication system including the antenna 1J which can transmit and receive a rotationally polarized wave in the invention and using a rotationally polarized wave as an electromagnetic wave and a rotationally polarized antenna 1J-1 serving as a terminal station are connected and placed. Base station devices 92, each of which includes a transmitter and a receiver of a wireless communication system including antennas which can transmit and receive rotationally polarized waves and using a rotationally polarized wave as an electromagnetic wave, the number of which is smaller than the number of transformers 91, are provided in the plurality of transformers 91.

In each of the base station devices 92, a wireless device 23 serving as a base station including an antenna which can transmit and receive a rotationally polarized wave and using a rotationally polarized wave as an electromagnetic wave and a rotationally polarized antenna 1J-2 of the base station are connected and placed. A size of the transformer 91 is in the order of several meters and is overwhelmingly large as compared with wavelengths corresponding to several hundred MHz to several GHz in a frequency range of an electromagnetic wave used by the wireless device. Therefore, an electromagnetic wave is subjected to multi-reflection by the plurality of transformers 91. Thus, a multi-path interference environment is formed.

In this embodiment, it is possible to achieve high-quality wireless transmission which compensates reduction in communication quality between a transmission side and a reception side with the use of a plurality of reflected waves in the multi-path interference environment. Therefore, the transformers 91 can be remotely controlled/monitored by the plurality of base station devices 92 with the use of wireless connecting means including the wireless devices instead of wired connecting means. Thus, it is possible to solve a problem of high-voltage induction power occurring when wired connecting means such as a cable is used and to remove a laying cost of the cable. This makes it possible to improve safety of a controlling/monitoring system of the transformers 91 and reduce costs thereof.

The invention is not limited to the above embodiments and includes various modification examples. For example, the above embodiments have been described in detail to easily understand the invention, and therefore the invention is not necessarily limited to the embodiments having all the configurations described above. Apart of a configuration of a certain embodiment can be replaced with a configuration of another embodiment, and a configuration of another embodiment can be added to a configuration of a certain embodiment. Another configuration can be also added to, removed from, or replaced with a part of a configuration of each embodiment.

In each embodiment, control lines and information lines, which are considered to be needed for the description, are shown and not all control lines and information lines are necessarily shown in terms of a product. It may be considered that almost all the configurations are practically connected to one another.

A shape of a plurality of minute conductor segments is not limited to square. The minute conductor segments only need to have a shape to fill a flat surface and may have a rectangular shape, a triangular shape, or a hexagonal shape.

REFERENCE SIGNS LIST

1, 1A-1J antenna (rotationally polarized antenna)
10 minute conductor segment
11 antenna structure (first area)
12 antenna structure (second area)
13 upper structure
14 lower structure
13J, 14J antenna
15, 15*a*, 15*b* conductor plate
151 feeding hole
16, 17 linear conductor
18 intermediate layer
19*a*, 19*b* feeding strip line

21 flat-surface composition circuit
31 high-frequency signal generation circuit (first circuit)
41 high-frequency signal generation circuit (second circuit)
3, 4, 5, 6, 31 feeding point
7 dielectric sheet
8 elevator system
82 building
83 ascending/descending car
84 high-frequency cable
9 transformation facility monitoring system
91 transformer
92 base station device

The invention claimed is:

1. A rotationally polarized antenna, wherein a feeding point is provided in an integrated plate conductor and is excited at a first frequency and a second frequency different from the first frequency, and matching with a feeding circuit is achieved in both a first frequency band including the first frequency and a second frequency band including the second frequency, such that current distribution formed in orthogonal directions on the plate conductor at the first frequency has the same amplitude and has a phase difference of 90 degrees, current distribution formed in the same orthogonal directions on the plate conductor at the second frequency has the same amplitude and has a phase difference of 90 degrees, and a phase of the current distribution at the first frequency and a phase of the current distribution at the second frequency have opposite directions.

2. The rotationally polarized antenna according to claim 1, wherein two feeding points are provided in the plate conductor, and one feeding point is excited at the first frequency and the other feeding point is excited at the second frequency.

3. The rotationally polarized antenna according to claim 2, wherein:

the plate has a first area and a second area apposed with the first area;

the one feeding point is provided in the first area; and the other feeding point is provided in the second area.

4. The rotationally polarized antenna according to claim 2, wherein:

the plate conductor has a first area and a second area surrounding the first area;

the one feeding point is provided in the first area; and the other feeding point is provided in the second area.

5. The rotationally polarized antenna according to claim 1, wherein a single feeding point is provided in the plate, and the single feeding point is excited at the first frequency and the second frequency.

6. The rotationally polarized antenna according to claim 1, wherein:

two plates are apposed; and a phase of orthogonal currents formed on one plate and a phase of orthogonal currents formed on the other plate are inverted from each other.

7. The rotationally polarized antenna according to claim 1, wherein the plate conductor includes a plurality of minute conductor segments.

8. The rotationally polarized antenna according to claim 7, wherein the two plates are placed in parallel to each other in the same direction, and feeding of power is performed between particular minute conductor segments included in each of the plates.

9. The rotationally polarized antenna according to claim 7, comprising a conductor plate placed in parallel to the plate and feeding power to a particular minute conductor segment included in the plate.

10. The rotationally polarized antenna according to claim 9, wherein:

a flat-surface composition circuit is formed on the conductor plate in a direction different from a direction in which the plate is provided; and modulated waves having different frequencies are input to respective input terminals of the flat-surface composition circuit.

11. The rotationally polarized antenna according to claim 7, wherein:

a first conductor plate and a second conductor plate form an intermediate layer, a first plate which is the plate is placed to face one side of the first conductor plate at a certain interval, a second plate which is the plate is placed to face the other side of the second conductor plate at a certain interval, the first conductor plate and the second conductor plate have the same high-frequency potential, and a first feeding line passing through the first conductor plate and a second feeding line passing through the second conductor plate are formed in the intermediate layer;

the first feeding line is connected to a particular minute conductor segment included in the first plate; and the second feeding line is connected to a particular minute conductor segment included in the second plate.

12. A transmission/reception module comprising:

the rotationally polarized antenna according to claim 1;

a first circuit excited at the first frequency; and a second circuit excited at the second frequency.

13. An elevator control system to which a wireless device including the rotationally polarized antenna according to claim 1 is applied.

14. A substation control system to which a wireless device including the rotationally polarized antenna according to claim 1 is applied.

* * * * *